US009233274B2

(12) United States Patent
Lau

(10) Patent No.: US 9,233,274 B2
(45) Date of Patent: Jan. 12, 2016

(54) COMBINATION SPIROMETER AND PEP BREATHING EXERCISER

(71) Applicant: Gregory Y. Lau, Cornelius, NC (US)

(72) Inventor: Gregory Y. Lau, Cornelius, NC (US)

(73) Assignee: D R Burton Healthcare, LLC, Las Vegas, NV (US)

( * ) Notice: Subject to any disclaimer, the term of this patent is extended or adjusted under 35 U.S.C. 154(b) by 35 days.

(21) Appl. No.: 13/803,351

(22) Filed: Mar. 14, 2013

(65) Prior Publication Data

US 2014/0274568 A1 Sep. 18, 2014

(51) Int. Cl.

| | |
|---|---|
| ***A63B 23/18*** | (2006.01) |
| ***A63B 21/008*** | (2006.01) |
| ***A63B 21/00*** | (2006.01) |

(52) U.S. Cl.

CPC ..... *A63B 23/18* (2013.01); *A63B 21/0085* (2013.01); *A63B 21/00196* (2013.01)

(58) Field of Classification Search

CPC ..... A63B 21/00; A63B 23/18; A63B 23/00

USPC ..... 482/13; 600/137, 251; 128/203.11

See application file for complete search history.

(56) References Cited

U.S. PATENT DOCUMENTS 6,581,598 B1 6/2003 Foran et al. ..... 128/204.23

*Primary Examiner* — Jerome W Donnelly

(74) *Attorney, Agent, or Firm* — Blake P. Hurt; Tuggle Duggins P.A.

(57) ABSTRACT

A combination spirometer and PEP breathing exercise device is described. The device includes a spirometer with a volumetric air chamber having an atmospheric opening, an exhaust port, and an indicator of inhalation rate or volume; a breathing tube having a proximal end in communication with the exhaust port, a distal end with a mouthpiece, and a conduit between the proximal and distal ends; a one-way check valve adjacent the exhaust port allowing air to flow from the spirometer through the breathing tube to the mouthpiece, but preventing air from being exhausted through the spirometer; and a PEP valve in communication with the breathing conduit, whereby expiration of air from the mouthpiece into the breathing tube above a preset pressure causes the valve to oscillate.

14 Claims, 3 Drawing Sheets

COMBINATION SPIROMETER AND PEP BREATHING EXERCISER

BACKGROUND OF THE INVENTION (1) Field of the Invention

The present invention relates to handheld devices for use in lung therapy through controlled inhalation and exhalation, and in particular to therapeutic devices that combine the functions of an incentive spirometer with a PEP breathing exerciser.

(2) Description of the Prior Art

Two handheld devices are commonly used in lung therapy exercises. The first of these devices, known as an incentive spirometer, is used in inhalation exercises to motivate the user in inhalation of a preset volume of air. The other type of the device, known as a PEP breathing exerciser or PEP breathing device, is used in exhalation exercises to help clear the lungs of mucus. Several different configurations of these devices are commercially available.

Generally, an incentive spirometer, sometimes referred to herein as a spirometer, is comprised of a chamber that is vented to the atmosphere and includes a ball or piston, and a breathing tube which has a proximal end in communication with the chamber and a distal end with a mouthpiece. In use, the patient inhales through the breathing tube to raise the ball or piston in the chamber. The chamber may be calibrated to indicate the amount of air being inhaled.

The spirometer may also include a second chamber or air source from which air is drawn into the breathing tube. This second chamber functions as a flowrate indicator. Its air circuit is also opened to the same inhalation gas stream with a smaller passageway for the stated purpose. By calibration, the rate of inhalation air critical to the opening of small airways at optimal conditions can be established.

PEP exercisers are used by patients to facilitate the removal of mucus in the lungs and strengthening the muscle tissues involved. A PEP exerciser is generally comprised of an exhalation tube that includes a resistor to airflow. The resistor may flutter or oscillate when air is expired, vibrating the airways to stimulate nerves and therefore promote coughing and loosening of mucus. The vibration may be created with a valve that is urged into a closed position with a spring or magnet, and temporarily opened by the force of exhalation.

Spirometers and PEP exercisers are sold as separate devices, although they are frequently used by the same patients. The need for separate devices for breathing exercises may add significantly to the cost of treatment. Keeping track of two devices is also inconvenient. Therefore, a separate breathing exercise device that functioned both as a spirometer and as a PEP exerciser would result in significant cost savings and convenience.

SUMMARY OF THE INVENTION

The present invention is directed to an improved breathing exercise device that can function as both an incentive spirometer and as a PEP exerciser with a single breathing tube being used for both inhalation and expiration. During inhalation, the device acts as a spirometer, while the device acts as a PEP exerciser during air expiration.

Generally, the combination breathing exercise device is comprised of a spirometer combined with a PEP exerciser valve and a check valve preventing expiration of air from the breathing tube to the atmosphere through the spirometer. Instead, expired air is discharged through the PEP exerciser valve. The PEP valve is preferably designed to rapidly oscillate between open and closed positions to release air. Oscillation of the valve also creates air vibration.

More specifically, the spirometer is comprised of an air chamber having an atmospheric opening and an indicator of inhalation rate or volume. For example, the chamber can be a vertical graduated cylinder with a piston or ball that is moveable up and down within the cylinder responsive to the volume of air being inhaled. A slidable pointer can be positioned along the cylinder to indicate a target volume. The air chamber is in communication with an exhaust port.

It is to be understood that the present invention is not limited to the exact configuration of the spirometer and is generally applicable to spirometers as the term is understood in the relevant art, i.e., a handheld device through which air is inhaled to measure airflow or volume. Generally, spirometers are defined as having a volume measuring canister from which the patient inhales through a breathing tube.

A positive expiratory pressure (PEP) exerciser is an exhalation device comprised of a one-way resistance PEP valve attached to an expiration breathing tube with a mouthpiece. Expiration through the PEP valve generates an oscillatory effect in the airway which will irritate/stimulate nerve endings to promote cough mechanism.

In a form of PEP exerciser known as an oscillating PEP exerciser, the valve is design to oscillate or flutter under the pressure of exhausted air, which vibrates the air in the lungs, ultimately helping to dislodge mucous. The valve in an oscillating PEP device is a poppet-type valve comprised of a poppet that is biased into engagement with an annular valve seat by a biasing means such as a spring or magnet. A bias adjustment means controls the force exerted by the biasing means. The valve remains closed until air pressure greater than a preset value opens the valve. When the air pressure is below the preset value, the valve closes. This opening and closing of the valve causes air vibration, which helps in vibrating the cilia and removing mucous.

A spirometer normally includes a flexible breathing tube that has a proximal end attached to the spirometer exhaust port, a distal end with a mouthpiece, and a tubular passageway extending between the proximal and distal ends of the mouthpiece.

In the present invention, a PEP valve is positioned between the breathing tube mouthpiece and the spirometer, and a check valve is added between the PEP valve and the atmospheric air inlet of the spirometer so that air cannot be exhausted to atmosphere through the spirometer. Instead, air expired through the breathing tube is directed through the PEP valve, causing the PEP valve to vibrate.

Preferably, the PEP valve extends from the wall of the breathing tube and does not extend into the breathing tube passageway. The longitudinal axis of the PEP valve is preferably transverse to the longitudinal axis of the breathing tube passageway. In one embodiment, the PEP valve extends from the wall of a tubular housing that has a proximal end attachable to the spirometer exhaust port and a distal end attachable to the proximal end of the breathing tube. The check valve can be positioned in the tubular housing between the PEP valve and the breathing tube proximal end.

The combination breathing exerciser can be used both as a spirometer and as a PEP exerciser. When used as a spirometer, the patient inhales through the breathing tube, causing the indicator to move within the spirometer cylinder to provide a visual indicator of the flowrate and volume of air being inspired. When used as a PEP exerciser, the patient breathes out through the same breathing tube where exhaustion of air through the spirometer is prevented by the check valve. Instead the air pressure periodically opens the PEP valve causing vibration of the air and cilia in the lungs. Thus, a single device is useful as a spirometer or as a PEP exerciser depending only on whether the patient is breathing in or out.

DETAILED DESCRIPTION OF THE INVENTION

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

Figure 2:
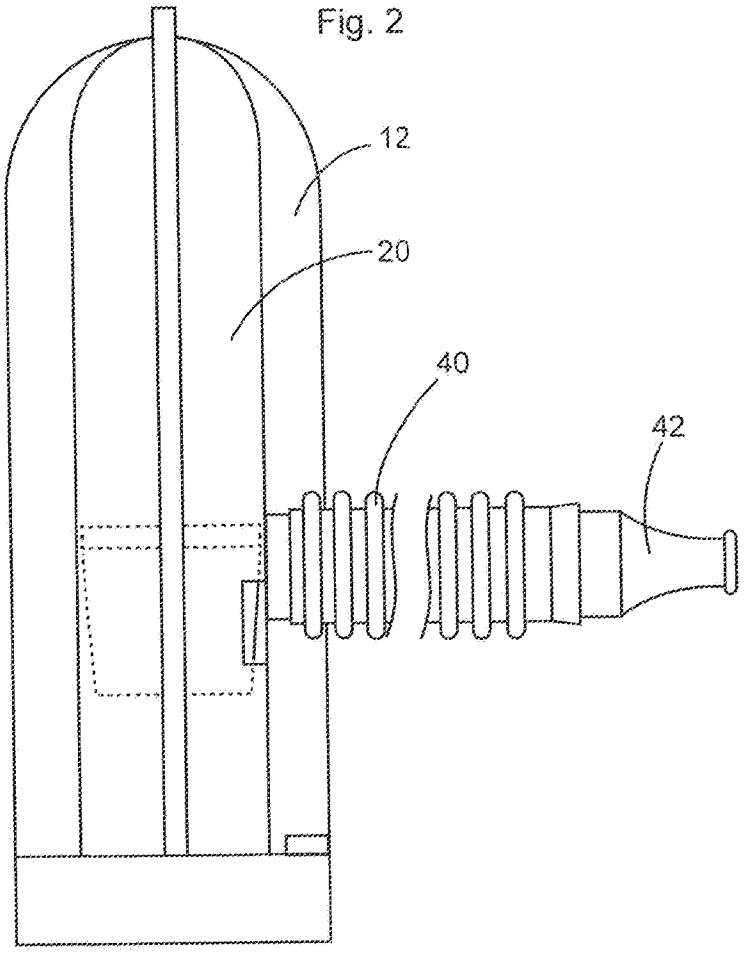
Fig. 2 PRIOR ART
FIG. 2 is a side view of a typical prior art incentive spirometer.
Figure 1:
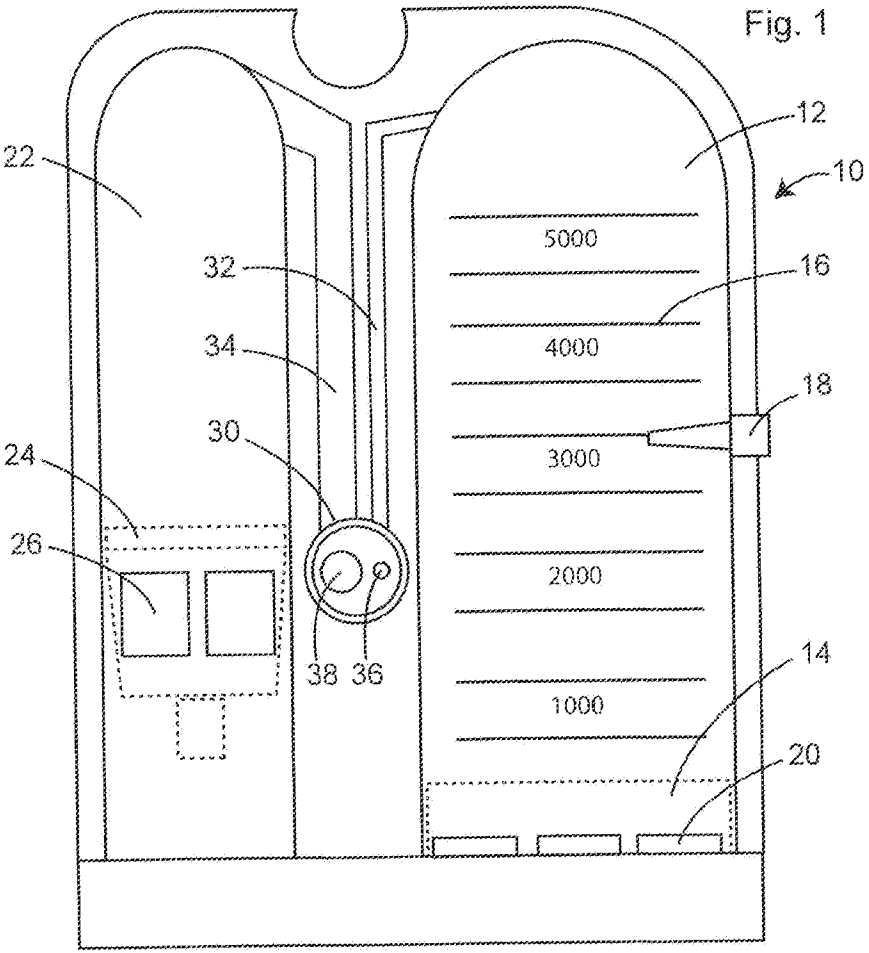
Fig. 1 PRIOR ART
FIG. 1 is a front view of a typical prior art incentive spirometer.

As best illustrated in FIGS. 1 and 2, a typical incentive spirometer, generally 10, is comprised of a volume measurement chamber 12 that includes a piston 14 moveable upwardly in chamber 12 upon evacuation of air as the patient inhales. Chamber 12, which is shown in the shape of a vertical cylinder, includes graduations 16 indicating the volume of air being inhaled. Chamber 12 may also include an indicator 18 slidably positionable to show a target volume. Atmospheric air is drawn into the lower end of chamber 12 trough air slots 20.

Spirometer 10 also includes a secondary chamber 22 that includes a counterweight 24 and atmospheric air inlets 26. Counterweight 24 is designed to move upwardly in chamber 22 as air is drawn in through inlets 26.

Chambers 12 and 20 communicate with an exhaust port 30 through conduits 32 and 34, respectively, which terminate at openings 36 and 38 in port 30. The proximal end of flexible breathing tube 40 is attached to port 30. A mouthpiece 42 is fitted to the distal end of tube 40. Air is inhaled through tube 40 in proportion to the cross-sectional areas of conduits 32 and 34. For example, if the cross-sectional area of conduit 32 is nine times the cross-sectional area of conduit 34, air will be drawn in a ratio of 9:1. Therefore, volume indicated by graduations 16 will be approximately 10% of the actual inhaled volume.

The spirometer illustrated in FIGS. 1 and 2 is only representative of typical spirometers. Numerous other designs are commercially available. It is to be understood that the present invention is applicable to spirometers generally and not to any one particular design.

Figure 4:
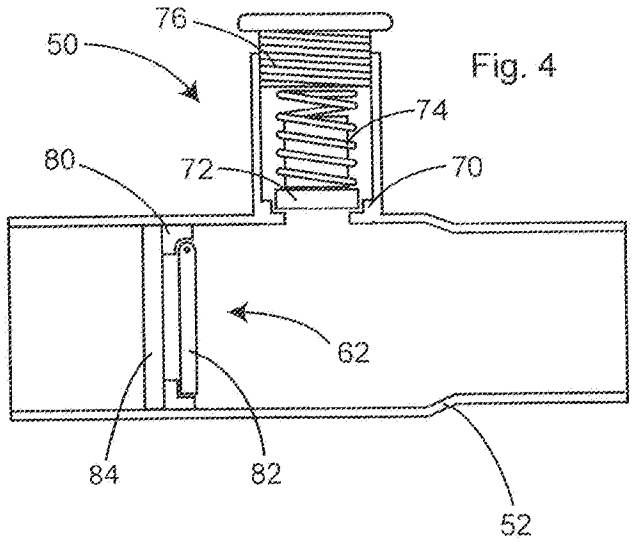
FIG. 4 is a sectional side view of a PEP valve and check valve insertable between a spirometer body and a breathing tube.
Figure 3:
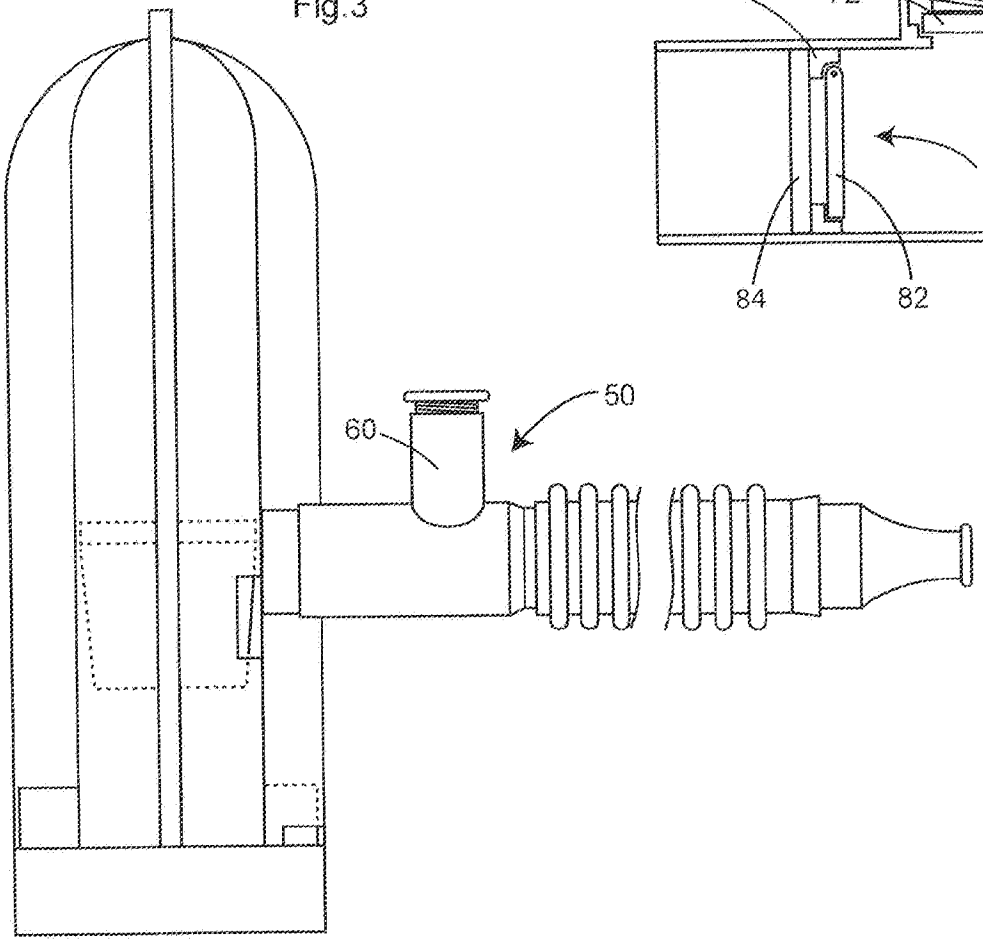
FIG. 3 is a side view of a combination incentive spirometer and PEP valve.

FIGS. 3 and 4 illustrate the combination of a PEP valve with a spirometer, permitting a single device to be used for both inhalation and exhalation exercises. As illustrated a PEP valve module, generally 50, is inserted between exhaust port 30 of spirometer 10 and the distal end of breathing tube 40. While PEP module 50 is shown as releasably attachable to port 30 and to tube 40, it will be understood that module 50 can also be integral with port 30 or tube 40. PEP module 50 can be sold separately to retrofit existing incentive spirometers.

Generally module 50 is comprised of a tubular housing 52 having a continuous outer wall. A PEP valve, generally 60, extends from the side wall of housing 52. PEP valve 60 is designed to remain closed until the air pressure within housing 52 exceeds a predetermined pressure. Module 50 also includes a one-way check valve 62 designed to prevent air from being exhausted through spirometer 10.

In the embodiment illustrated, PEP valve 60 includes an annular valve seat 70, a valve plug 72, a spring 74 urging plug 72 against seat 70, and a bias adjustment screw 76 to change the compression of spring 74 and thereby the force required to open valve 60. Check valve 62 is comprised of an annular valve seat 80 and a valve gate or plug 82 that is spring loaded to a normally closed position. If desired, an air filter 84, preferably a HEPA filter, can be positioned within module 50 or elsewhere between the spirometer and the PEP valve. The designs of valves 60 and 62 are merely representative. One skilled in the art will appreciate that various other designs are equally suitable. The only requirements are that valve 60 remains closed until the air pressure within housing 52 exceeds a preset value, and that valve 62 only allows air to flow one way in tube 40, i.e., from the proximal end to the distal end of tube 40.

Figure 5:
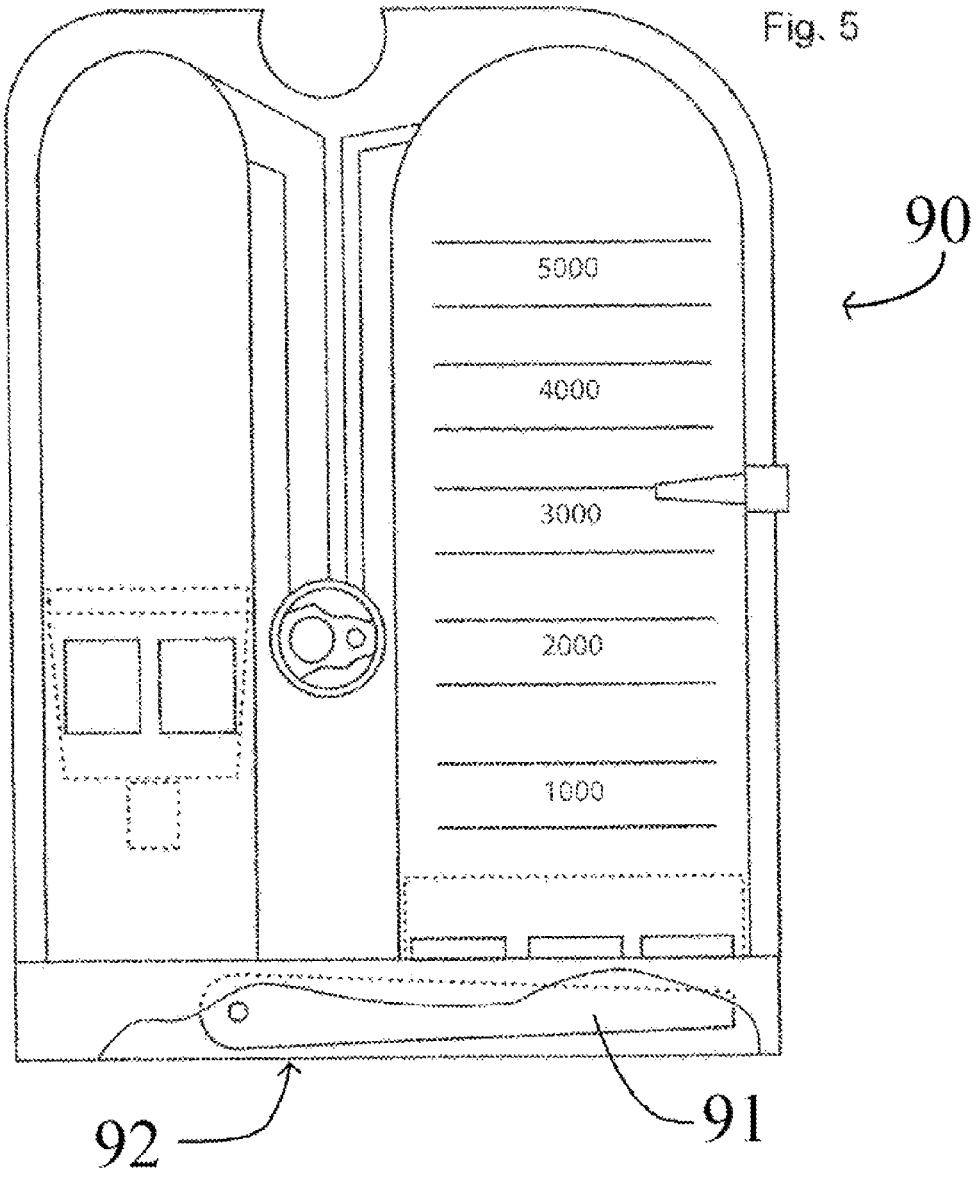
FIG. 5 is a front view of an incentive spirometer with a folding handle added in the recess in the bottom of the spirometer.

FIG. 5 illustrates the modification of a spirometer 90 by the addition of a folding handle 91 inside the bottom recess 92 of the spirometer. Handle 91 is sized to be completely within recess 92 when folded so that it does not interfere with placement of spirometer 90 on a surface. However, handle 91 can be unfolded to extend downwardly for a convenient grip during use of spirometer 90.

Certain modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. An improved breathing exercise device comprising:

a) a spirometer having an exhaust port;

b) a breathing tube having a proximal end in communication with said exhaust port, a distal end with a mouthpiece, and a conduit between said proximal and distal ends;

c) a one-way check valve allowing air to flow from said spirometer through said breathing tube to said mouthpiece, but preventing air from being exhausted through said spirometer; and d) a PEP valve in communication with said breathing conduit, whereby expiration of air from said mouthpiece into said breathing tube above a preset pressure causes said valve to open.

2. The exercise device of claim 1, wherein said valve including a valve seat, a valve plug, and a biasing means urging said valve plug against said seat.

3. The exercise device of claim 1, wherein said spirometer includes a volumetric air chamber having an atmospheric opening, an exhaust port, and an in indicator of inhalation rate or volume.

4. The exercise device of claim 1, further including a tubular housing having a proximal end attached to said spirometer exhaust port and a distal end attached to the proximal end of said breathing tube, said PEP valve extending outwardly from said tubular housing, and said check valve being within said tubular housing.

5. The exercise device of claim 1, wherein said spirometer includes a base having a lower face with a recess, and a foldable handle in said recess.

6. The exercise device of claim 1, wherein said PEP valve is an oscillating PEP valve.

7. An improved breathing exercise device comprising:

a) a spirometer including a volumetric air chamber having an atmospheric opening, an exhaust port, and an in indicator of inhalation rate or volume;

b) a breathing tube having a proximal end in communication with said exhaust port, a distal end with a mouthpiece, and a conduit between said proximal and distal ends;

c) a one-way check valve adjacent said exhaust port allowing air to flow from said spirometer through said breathing tube to said mouthpiece, but preventing air from being exhausted through said spirometer; and d) an oscillating PEP valve in communication with said breathing conduit, whereby expiration of air from said mouthpiece into said breathing tube above a preset pressure causes said valve to oscillate.

8. The exercise device of claim 7, wherein said PEP valve including a valve seat, a valve plug, and a biasing means urging said valve plug against said seat.

9. The exercise device of claim 8, wherein said biasing means is a spring.

10. The exercise device of claim 8, wherein said valve includes a resistance adjustment.

11. The exercise device of claim 7, further including a base having a lower face with a recess, and a foldable handle in said recess.

12. The exercise device of claim 7, further including a HEPA filter between said chamber and said breathing tube.

13. The exerciser of claim 7, wherein said spirometer chamber is a vertical cylinder and said indicator is a ball or piston moveable up and down in said cylinder responsive to air intake volume.

14. The exerciser of claim 7, further including a secondary air inlet in communication with said exhaust port.

* * * * *